US009062903B2

(12) United States Patent
Sjoholm et al.

(10) Patent No.: US 9,062,903 B2
(45) Date of Patent: Jun. 23, 2015

(54) ECONOMIZER COMBINED WITH A HEAT OF COMPRESSION SYSTEM

(75) Inventors: Lars I. Sjoholm, Burnsville, MN (US); Peter W. Freund, Bloomington, MN (US); P. Robert Srichai, Minneapolis, MN (US); Jeffrey B. Gronneberg, Prior Lake, MN (US)

(73) Assignee: THERMO KING CORPORATION, Minneapolis, MN (US)

( * ) Notice: Subject to any disclaimer, the term of this patent is extended or adjusted under 35 U.S.C. 154(b) by 350 days.

(21) Appl. No.: 13/345,844

(22) Filed: Jan. 9, 2012

(65) Prior Publication Data

US 2013/0174590 A1 Jul. 11, 2013

(51) Int. Cl.

| | |
|---|---|
| ***F25B 13/00*** | (2006.01) |
| ***F25B 41/04*** | (2006.01) |
| *F25B 47/02* | (2006.01) |

(52) U.S. Cl.

CPC ..... *F25B 41/04* (2013.01); *F25B 47/022* (2013.01); *F25B 2400/13* (2013.01); *F25B 2400/16* (2013.01); *F25B 2600/2501* (2013.01); *F25B 2600/2507* (2013.01)

(58) Field of Classification Search

USPC ..... 62/324.6, 196.1, 528

See application file for complete search history.

(56) References Cited

U.S. PATENT DOCUMENTS

| | | | | |
|---|---|---|---|---|
| 2,104,148 | A * | 1/1938 | Alexander et al. | 62/134 |
| 4,258,553 | A * | 3/1981 | Kelly et al. | 62/117 |
| 4,850,197 | A * | 7/1989 | Taylor et al. | 62/81 |
| 5,095,712 | A | 3/1992 | Narreau | |
| 5,157,933 | A * | 10/1992 | Brendel | 62/196.4 |
| 5,189,883 | A * | 3/1993 | Bradford | 62/83 |
| 5,400,609 | A | 3/1995 | Sjoholm et al. | |
| 5,410,889 | A | 5/1995 | Sjoholm et al. | |
| 5,465,587 | A * | 11/1995 | Sjoholm et al. | 62/84 |
| 5,557,941 | A | 9/1996 | Hanson et al. | |
| 5,596,878 | A | 1/1997 | Hanson et al. | |
| 6,148,632 | A | 11/2000 | Kishita et al. | |
| 6,374,631 | B1 | 4/2002 | Lifson et al. | |
| 6,385,981 | B1 * | 5/2002 | Vaisman | 62/196.3 |
| 6,684,650 | B2 | 2/2004 | Weyna et al. | |
| 6,708,510 | B2 * | 3/2004 | Sulc et al. | 62/151 |
| 6,817,205 | B1 | 11/2004 | Lifson et al. | |
| 6,826,921 | B1 * | 12/2004 | Uselton | 62/176.6 |
| 6,892,553 | B1 | 5/2005 | Lifson et al. | |
| 6,941,770 | B1 | 9/2005 | Taras et al. | |
| 6,990,826 | B1 | 1/2006 | Lifson et al. | |
| 7,000,423 | B2 | 2/2006 | Lifson et al. | |
| 7,003,975 | B2 * | 2/2006 | Feuerecker | 62/324.5 |
| 7,137,270 | B2 | 11/2006 | Lifson et al. | |
| 7,143,594 | B2 | 12/2006 | Ludwig et al. | |
| 7,257,955 | B2 | 8/2007 | Lifson et al. | |

(Continued)

OTHER PUBLICATIONS

International Search Report and Written Opinion for Application No. PCT/US2012/070483 dated Apr. 8, 2013 (9 pages).

*Primary Examiner* — Lakiya Rogers
*Assistant Examiner* — David Teitelbaum
(74) *Attorney, Agent, or Firm* — Hamre, Schumann, Mueller & Larson, P.C.

(57) ABSTRACT

A refrigeration system having a cooling circuit, a heating circuit, a pressurizing receiver tank circuit, a pilot circuit and a liquid injection circuit wherein the hot gas line includes a solenoid valve that connects an outlet of a compressor to an outlet of a receiver tank, and wherein the liquid injection circuit includes a liquid injection solenoid that connects the outlet of the receiver tank to an outlet of an economizer.

12 Claims, 4 Drawing Sheets

(56) References Cited

U.S. PATENT DOCUMENTS

| | | | | |
|---|---|---|---|---|
| 7,272,948 | B2 | 9/2007 | Taras et al. | |
| 7,523,623 | B2 | 4/2009 | Taras et al. | |
| 2004/0084175 | A1 | 5/2004 | Kranz et al. | |
| 2008/0098760 | A1 | 5/2008 | Seefeldt | |
| 2009/0025405 | A1 | 1/2009 | Yanik | |
| 2009/0235678 | A1 * | 9/2009 | Taras et al. | 62/115 |
| 2009/0293515 | A1 | 12/2009 | Lifson et al. | |
| 2009/0320506 | A1 | 12/2009 | Lifson et al. | |

* cited by examiner

ECONOMIZER COMBINED WITH A HEAT OF COMPRESSION SYSTEM

FIELD OF INVENTION

The present invention relates to refrigeration systems that can be operated in a cooling cycle, a heating/defrost cycle, a pump-down cycle and a null cycle, and wherein an economizer circuit is incorporated into the system to provide augmented performance and enhanced control.

SUMMARY

In one embodiment, the invention provides a refrigeration system having a cooling circuit, a heating circuit, a pressurizing receiver tank circuit, a pilot circuit and a liquid injection circuit wherein the hot gas line includes a solenoid valve that connects an outlet of a compressor to an outlet of a receiver tank, and wherein the liquid injection circuit includes a liquid injection solenoid that connects the outlet of the receiver tank to an outlet of an economizer heat exchanger.

In another embodiment, the invention provides a refrigeration system operable to run in a cooling cycle, a heating cycle and a null cycle, the refrigeration system having a compressor having a suction port and an output port, said compressor configured to receive refrigerant from the suction port, compress the refrigerant, and discharge the refrigerant through the output port. The refrigeration system also includes a condenser selectively connected to the output port and configured to selectively receive the compressed refrigerant from the compressor and condense the compressed refrigerant, and an economizer having a hot section and a cooling section, the hot section and cooling section being in thermodynamic contact with each other, said hot section being connected to the condenser and selectively receiving at least one of the condensed refrigerant from the condenser and the compressed refrigerant from the compressor, said cooling section receiving a first portion of refrigerant which has passed through the hot section and a first expansion device. Furthermore, the refrigeration system has a second expansion device connected to the hot section of the economizer and configured to receive a second portion of refrigerant which is not passed to the cooling section of the economizer, an evaporator connected to the second expansion device and configured to receive refrigerant from at least one of the second expansion device and the compressor output port, and a first solenoid valve fluidly connected to the output port of the compressor, said first solenoid valve selectively allowing the compressed refrigerant to pass through the solenoid valve to the cooling portion of the economizer to allow the refrigeration system to at least one of run the null cycle and generate additional mass flow into the compressor during the heating cycle. Finally, the invention further includes a second solenoid valve configured to receive condensed refrigerant which has passed through the condenser, said second solenoid valve selectively allowing the condensed refrigerant to pass through the second solenoid valve to the suction port of the compressor to at least one of lower the discharge temperature of the compressed refrigerant being discharged through the output port and lower the suction superheat of the compressor.

Yet another embodiment of the invention is a method of operating a refrigeration system in a null cycle, the method including compressing refrigerant using a compressor, passing a portion of the compressed refrigerant from the compressor through a first solenoid valve to reduce the pressure of the compressed refrigerant to a middle pressure, receiving a remaining portion of the compressed refrigerant from the compressor in a condenser to condense the compressed refrigerant, and receiving the condensed refrigerant from the condenser in a hot portion of the economizer. The invention further includes passing the condensed refrigerant from the hot portion of the economizer through an expansion device to reduce the condensed refrigerant to a middle pressure, combining the portion of medium pressure refrigerant with the remaining portion of refrigerant which has been condensed and reduced to a middle pressure, and receiving the combined refrigerant portions in a cooling section of an economizer. Finally, the invention also includes receiving the combined portions of refrigerant from the cooling section in a suction port of the compressor to allow the refrigeration system to run in the null cycle.

Another embodiment of the invention is a method of controlling the charge of a heating circuit, the method including compressing refrigerant using a compressor, receiving a first portion of the compressed refrigerant from the compressor in an evaporator, transferring heat from the first portion of the compressed refrigerant in the evaporator to a medium to be heated, reducing the first portion to a middle/low pressure, receiving the first portion middle/low pressure refrigerant from the evaporator in a suction port of the compressor, and receiving a second portion of the compressed refrigerant from the compressor in a hot section of an economizer. The embodiment also includes expanding the second portion using a first expansion device to lower the pressure to a middle pressure, receiving a third portion of the compressed refrigerant from the compressor in a liquid injection solenoid, expanding the third portion using the liquid injection solenoid receiving the third portion from the liquid injection solenoid in an auxiliary suction port of the compressor, and expanding the remaining portion of the compressed refrigerant from the compressor using a second expansion device to reduce the compressed refrigerant to a middle pressure. Finally, the embodiment further includes combining the remaining portion of compressed refrigerant that has been expanded with the second portion of refrigerant that has been expanded to form a combined refrigerant, receiving the combined refrigerant in a cooling section of the economizer, and receiving the combined refrigerant from the cooling section in a second suction port of the compressor.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
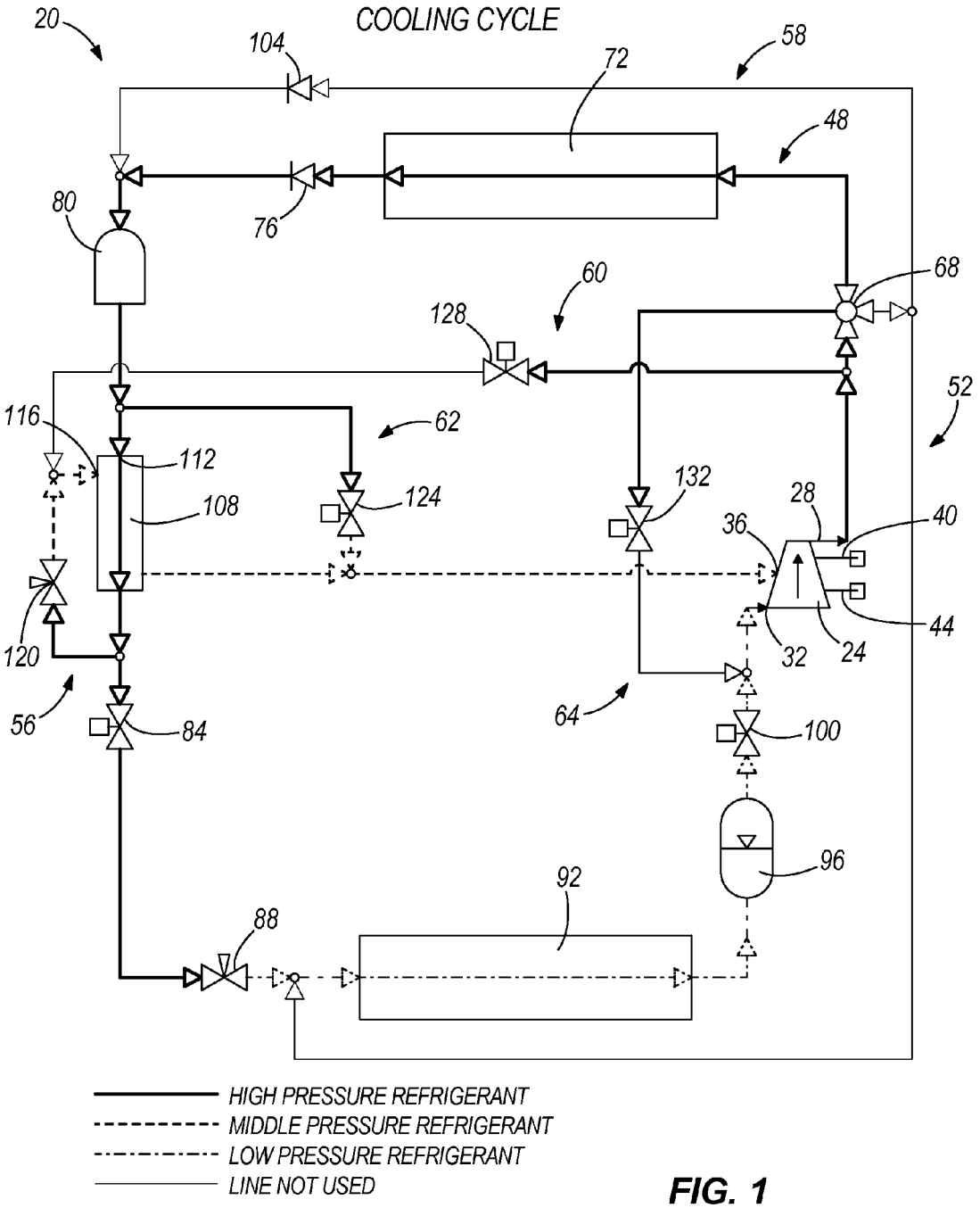
FIG. 1 is a schematic view of the present invention operating in a cooling cycle.

FIG. 1 is a schematic view of a refrigeration system 20 operating in a cooling cycle. The refrigeration system 20 is capable of being operated in a pump-down cycle (FIG. 2), a heating or defrost cycle (FIG. 3) and a null cycle (FIG. 4). The refrigeration system 20 includes a compressor 24 which compresses a refrigerant, the compressor 24 having an output port 28, a suction port 32, an auxiliary suction port 36, and a unloader solenoid 40. Some embodiments of the compressor 24 also include a second unloader solenoid 44 to increase the flexibility that can be achieved in reducing the unit capacity, compressor power input and compressor discharge pressure. In yet other embodiments the compressor 24 may be a digital scroll compressor or a screw compressor. The refrigeration system 20 includes a cooling circuit 48, a heating or defrost circuit 52, an economizer line 56, a pressurizing receiver tank circuit 58, a hot gas line 60, a liquid injection circuit 62 and a pilot line 64.

The cooling circuit 48 includes a 3-way valve 68 configured to receive compressed high pressure refrigerant from the compressor 24. A condenser coil 72 is configured to receive high pressure refrigerant from an output of the 3-way valve 68. A condenser check valve 76 is configured to receive high pressure refrigerant from the condenser coil 72. A receiver tank 80 is configured to receive high pressure refrigerant from at least one of the condenser check valve 76 and the pressurizing receiver tank circuit 58. The receiver tank 80 is connected to the economizer heat exchanger 108 and the liquid injection circuit 62. The economizer heat exchanger 108 is connected to the economizer line 56 and to a liquid line solenoid 84, the liquid line solenoid 84 being part of the cooling circuit 48. A thermostatic expansion valve 88 is configured to receive high pressure refrigerant from the liquid line solenoid 84. An evaporator coil 92 is configured to receive at least one of low pressure refrigerant from the thermostatic expansion valve 88 and high pressure refrigerant from the heating circuit 52. The evaporator coil 92 is connected to the suction port 32 of the compressor 24. In some embodiments, at least one of an accumulator 96 and an electronic throttle valve 100 are disposed between the evaporator coil 92 and the compressor 24.

The heating circuit 52 receives compressed high pressure refrigerant from the 3-way valve 68. Upon leaving the 3-way valve 68, the high pressure refrigerant goes to at least one of a pressurizing receiver tank circuit check valve 104 and the cooling circuit 48 at a point between the thermostatic expansion valve 88 and the evaporator coil 92. High pressure refrigerant leaves the pressurizing receiver tank circuit check valve 104 and is sent to the cooling circuit 48 at a point between the condenser check valve 76 and the receiver tank 80.

The economizer line 56 is located at a point between the economizer heat exchanger 108 and the liquid line solenoid 84 of the cooling circuit 48. An economizer heat exchanger 108 includes a hot section 112 and a cooling section 116 which are in thermodynamic contact with each other. The hot section 112 receives high pressure refrigerant from the receiver tank 80. The high pressure refrigerant exits the hot section 112, where a portion of the high pressure refrigerant may enter the liquid line solenoid 84. A portion of the high pressure refrigerant exiting the hot section 112 may be directed toward an economizer thermostatic expansion valve 120 and ultimately into the cooling section 116. Refrigerant exits the cooling section 116 and moves to the auxiliary suction inlet 36 which allows for refrigerant to enter the compressor 24 from the economizer heat exchanger 108. The liquid injection circuit 62 may also be used during the heat or defrost cycle to push refrigerant into the heat cycle if it is determine that the cycle is undercharged.

The hot gas line 60 provides a way for high pressure refrigerant from the compressor 24 to go directly to the cooling section 116 of the economizer heat exchanger 108. High pressure refrigerant leaves the cooling circuit 48 at a location between the 3-way valve 68 and the compressor 24, the high pressure refrigerant then passes through a hot gas solenoid valve 128. After passing through the hot gas solenoid valve 128, the high pressure refrigerant enters the cooling section 116. During the heat or defrost cycle if the heating capacity is low then the hot gas solenoid 128 can be opened to increase the mass flow of refrigerant into the auxiliary suction port 36 thereby increasing the discharge pressure which then increases the power consumption of the compressor 24 resulting in increasing the heating capacity output in the evaporator 92. The hot gas line 60 may also be used during the null cycle. In the null cycle, hot gas that is throttled from the hot gas solenoid 128 is mixed with cold 2-phase refrigerant coming from the economizer thermostatic expansion valve 120 to essentially produce a vapor outlet at the economizer heat exchanger 108 which is fed to the compressor 24 through the auxiliary suction port 36. During the null cycle, no refrigerant is fed to the evaporator 92 resulting in a true null cycle achieved with the compressor 24 running.

The pilot line 64 connects the 3-way valve 68 to the suction port 32 of the compressor 24. High pressure refrigerant leaves the 3-way valve 68 and then passes through a pilot solenoid 132. After passing through the pilot solenoid 132, the high pressure refrigerant enters the suction port 32. The pilot line 64 allows for the 3-way valve 68 to shift between the two positions on the valve. The operation of the 3-way valve 68 is such that it relies on a pressure difference across a piston which is connected to the suction port 32 on one side and the pilot line 64 on the other. When the pilot solenoid 132 is closed, the pressures on the piston are identical and the spring force located inside the 3-way valve 68 forces the piston to a first direction such that the output of the 3-way valve is to the condenser 72. When the pilot solenoid valve 132 is opened, the pressure on the side of the piston toward the pilot solenoid valve 132 is lost and thus the inlet pressure on the other side of the piston is greater than the pressure on the pilot solenoid valve side. This pressure differential creates a force that can overcome the pressure from the spring and thus forces the 3-way valve 132 to shift in a second direction and thus the output of the 3-way valve 68 is toward the evaporator 92.

The refrigeration system 20 is selectively operable in a cooling cycle to provide cooled refrigerant to the evaporator coil 92. The refrigeration system 20 is selectively operable in a heating cycle or defrost cycle to provide heated refrigerant to the evaporator coil 92. The refrigeration system 20 is selectively operable in a pump-down cycle which minimizes the possibility of liquid slugging at the compressor 24 prior to entering the heating or defrost cycles. The refrigeration system 20 is selectively operable in a null cycle which allows the refrigeration system 20 to achieve no heating or cooling capacity in evaporator 92. The refrigeration cycle includes unloader solenoids 40, 44 which actuate between closed and open positions to vary the capacity of the compressor and thus affecting the cooling or heating capacity.

When the refrigeration system 20 is run in the cooling cycle, as shown in FIG. 1, the refrigeration flows as follows. The compressor 24 compresses refrigerant to a high pressure and then the refrigerant is passed toward the 3-way valve 68. Before reaching the 3-way valve 68, a conduit branches off allowing refrigerant to pass toward the hot gas solenoid valve 128. During the cooling cycle the hot gas solenoid valve 128 is closed. The three-way valve 68 allows refrigerant to pass toward the pilot solenoid 132, which is closed. The three-way valve 68 also allows refrigerant to pass into the condenser coil 72, where heat is removed from the high pressure refrigerant. The high pressure refrigerant then leaves the condenser coil 72 and passes through the condenser check valve 76. After passing through the condenser check valve 76, the high pressure refrigerant enters into the receiver tank 80. The high pressure refrigerant then leaves the receiver tank 80 and a portion of the high pressure refrigerant is passed toward the liquid injection solenoid 124 while another portion of the high pressure refrigerant is passed toward the hot portion 112 of the economizer heat exchanger 108. While passing through the liquid injection solenoid 124 the pressure of the refrigerant is reduced to a middle pressure and is then passed toward the auxiliary suction port 36 of the compressor 24. The refrigerant that enters the hot portion 112 leaves the hot portion 112 at a high pressure and a portion is passed toward the liquid line solenoid 84 and a portion is passed toward the economizer thermostatic expansion valve 120. The refrigerant that passes through the economizer thermostatic expansion valve 120 has its pressure reduced to a middle pressure, thus refrigerant temperature is dropped. The refrigerant then leaves the economizer thermostatic expansion valve 120 and is passed toward the cooling portion 116 of the economizer 112 where it is in thermal contact with the refrigerant in the hot portion 112, thus cooling the high pressure refrigerant in the hot portion 112. After passing through the cooling portion 116 of the economizer heat exchanger 108, the refrigerant enters the same line as the refrigerant that has passed through the liquid injection solenoid 124 and the combined refrigerant is passed toward the auxiliary suction port 36.

The portion of refrigerant that is passed toward the liquid line solenoid 84 passes through the liquid line solenoid 84, and then passes through the thermostatic valve 88 where the refrigerant is reduced to a low pressure, thus the refrigerant temperature drops. The refrigerant then passes through the evaporator coil 92, where it may absorb heat. After leaving the evaporator coil 92 the refrigerant is passed toward the suction port 32 of the compressor 24. In some embodiments, after passing through the evaporator coil 92, the refrigerant may pass through at least one of an accumulator 96 and an electronic throttle valve 100. In some embodiments the liquid injection solenoid 124 may close when the temperature of the refrigerant leaving the compressor 24 drops below a certain temperature. In other embodiments the liquid injection solenoid 124 may open when the temperature of the refrigerant leaving the compressor 24 meets or exceeds a certain temperature.

Figure 2:
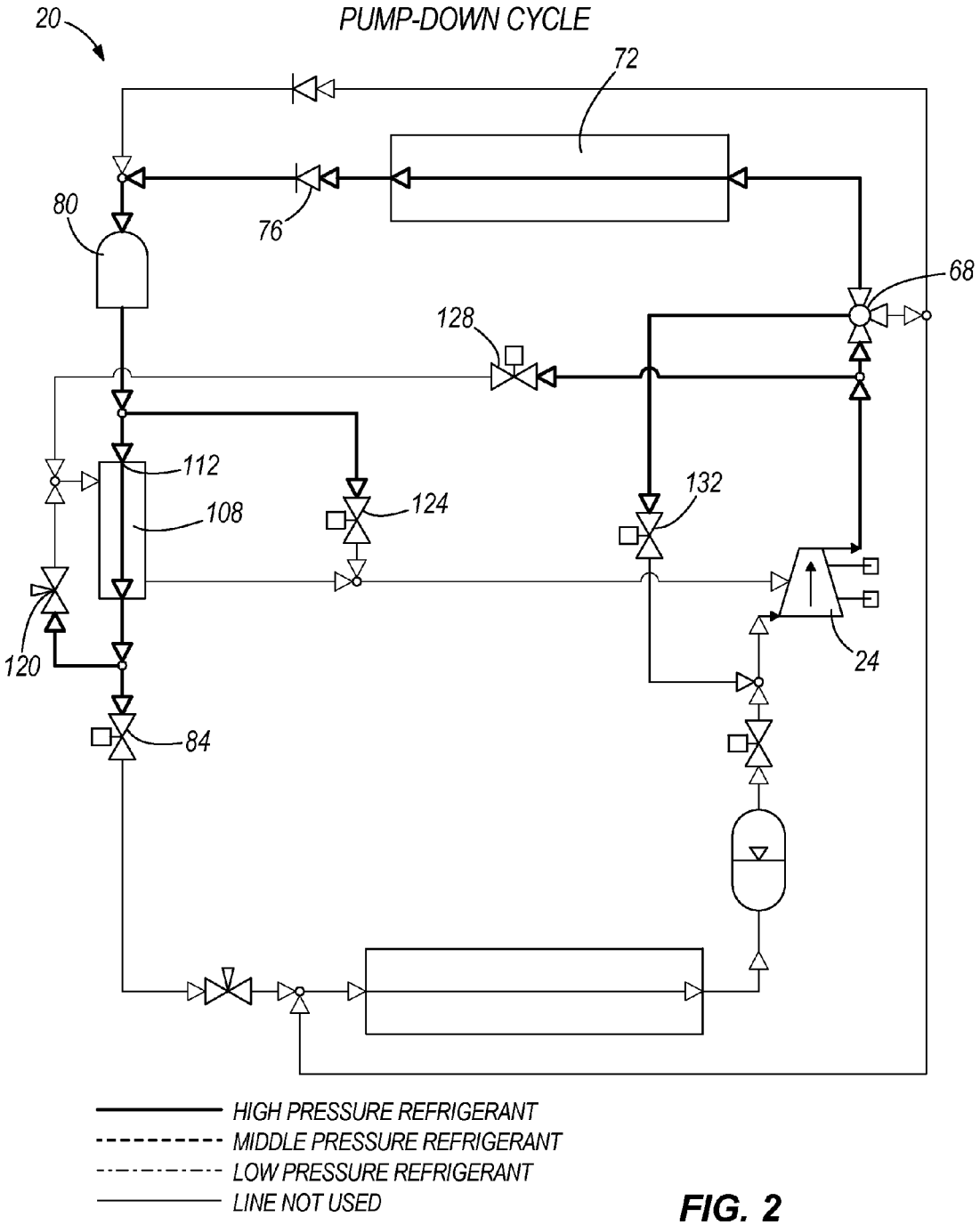
FIG. 2 is a schematic view of the invention of FIG. 1 operating in a pump-down cycle.

When the refrigeration system 20 is run in the pump-down cycle, as shown in FIG. 2, the refrigerant flows as follows. The compressor 24 compresses refrigerant to a high pressure, the high pressure refrigerant is then sent toward the 3-way valve 68. Before reaching the 3-way valve 68, a portion of refrigerant passes toward the hot gas solenoid valve 128, which is closed during the pump-down cycle. After passing through the 3-way valve 68 refrigerant is passed toward the pilot solenoid 132, which is closed during the pump-down cycle, and toward the condenser coil 72 where heat is removed from the high pressure refrigerant. The high pressure refrigerant then leaves the condenser coil 72 and passes through the condenser check valve 76. After passing through the condenser check valve 76, the high pressure refrigerant enters into the receiver tank 80. The high pressure refrigerant then leaves the receiver tank 80 and a first portion of the high pressure refrigerant goes to the liquid injection solenoid 124 while a second portion of the high pressure refrigerant goes into 112 of the economizer heat exchanger 108. The first portion of the high pressure refrigerant goes to the liquid injection solenoid 124 which is closed. The second portion of refrigerant passes through 112 of the economizer heat exchanger 108 and then toward both the economizer thermostatic expansion valve 120, which is thermally closed, and the liquid line solenoid 84, which is closed. When the refrigeration system 20 is run in the pump-down cycle refrigerant is not returned to the compressor 24. The pump-down cycle may be run before the heat cycle or defrost cycle, allowing the refrigeration system 20 to store refrigerant charge in the refrigerant lines near the liquid line solenoid 84. The liquid injection valve 124 is used to bring the stored charge into the defrost or heat cycle as necessary to get sufficient heat while still allowing primarily superheated vapor into the suction port 32. In some circumstances too much charge may enter the heat or defrost cycle or conditions change such that there is too much charge in the heat or defrost cycle, in these cases liquid refrigerant may enter the suction port 32 which is undesirable as liquid refrigerant in the compressor 24 can lead to compressor failure. If such circumstances are detected, then the refrigeration system 20 may momentarily shift the refrigeration system 20 back to the pump-down cycle and then back to the heat or defrost cycle and again use the liquid injection solenoid 124 to bring the correct amount of charge into the heat or defrost cycle.

Figure 3:
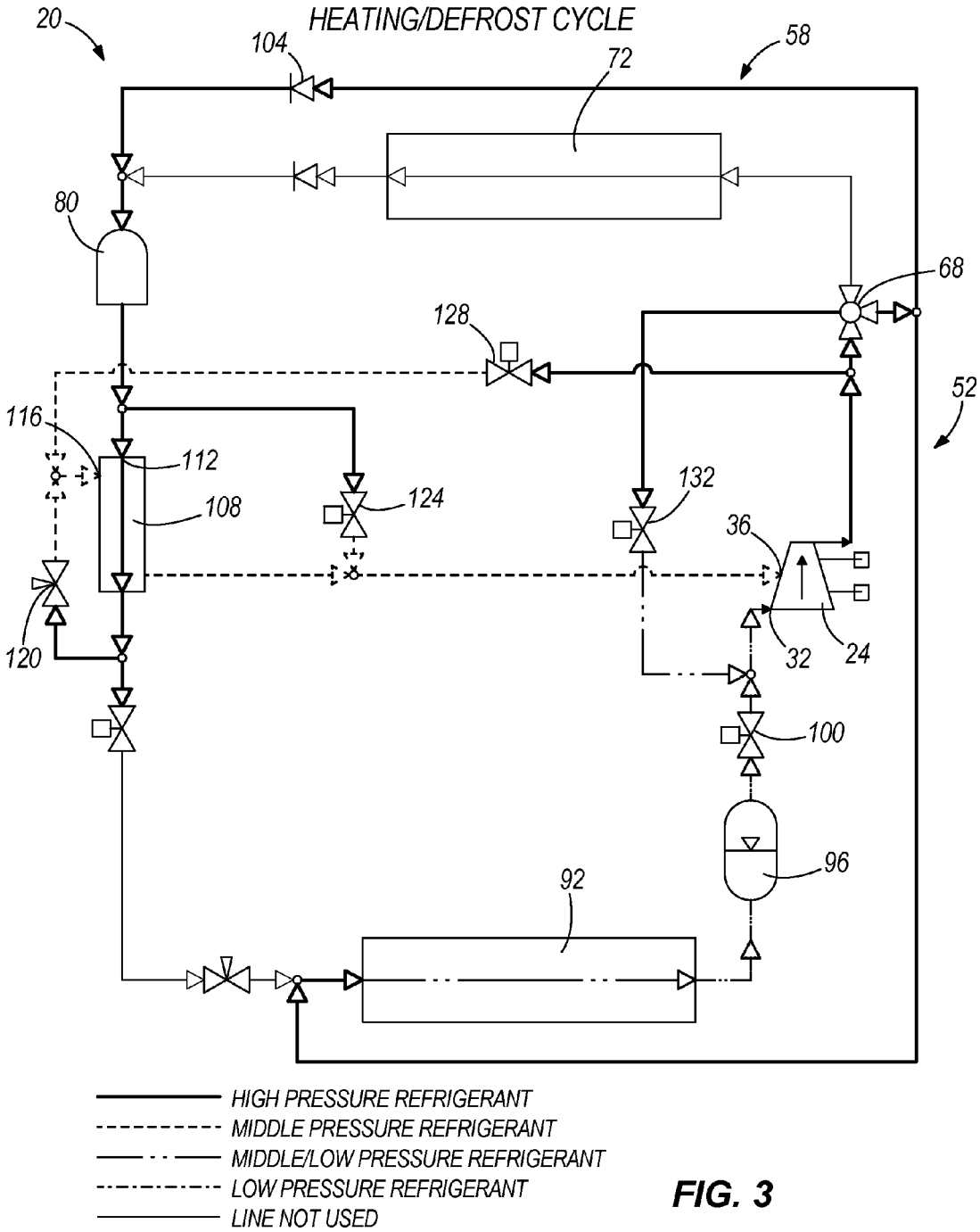
FIG. 3 is a schematic view of the invention of FIG. 1 operating in a heating/defrost cycle.
Figure 4:
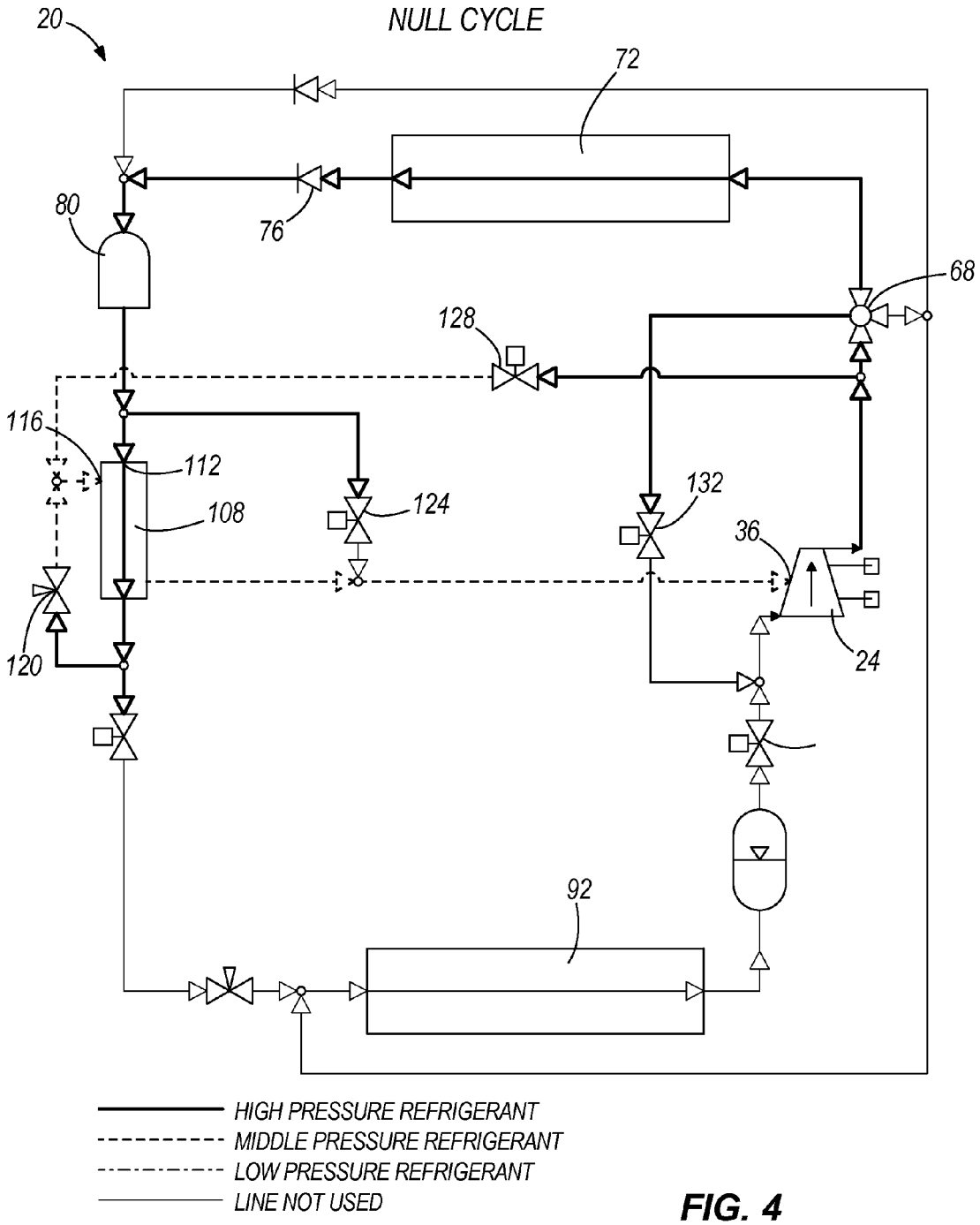
FIG. 4 is a schematic view of the invention of FIG. 1 operating in a null cycle.

When the refrigeration system 20 is run in the heating or defrost cycle, as shown in FIG. 3, the refrigerant flows as follows. The compressor 24 compresses refrigerant to a high pressure, the high pressure refrigerant is then sent toward the 3-way valve 68. Before reaching the 3-way valve 68, a portion of refrigerant passes toward the hot gas solenoid valve 128 which may be open. The high pressure refrigerant that passes through the hot gas solenoid valve 128 has its pressure reduced to a middle pressure, and then the middle pressure refrigerant is passed toward the cooling portion 116 of the economizer heat exchanger 108. The high pressure refrigerant that passes into the 3-way valve 68 is split, a portion is passed toward the pilot solenoid 132 and another portion is passed toward the pressurizing receiver tank circuit 58 and the heating circuit 52. The refrigerant that passes through the pilot solenoid 132 is reduced to a middle/low pressure while passing through the pilot solenoid 132, and then is passed toward the suction port 32 of the compressor 24. The high pressure refrigerant exiting the 3-way valve 68 is split to the pressurizing receiver tank circuit 58 and the heating circuit 52. The portion of the refrigerant entering the pressurizing receiver tank circuit 58 goes toward the pressurizing receiver tank circuit check valve 104. The other portion of the refrigerant which enters the heating circuit 52 goes toward the evaporator coil 92. The refrigerant that goes toward the pressurizing receiver tank circuit check valve 104 passes through the pressurizing receiver tank circuit check valve 104 and the receiver tank 80, and then a portion of the refrigerant is passed toward the liquid injection solenoid 124. Another portion of the refrigerant is passed toward the economizer heat exchanger 108, where it enters into the hot section 112. After passing through the hot section 112 the refrigerant passes through the economizer thermostatic expansion valve 120 where the refrigerant goes from a high pressure to a middle pressure. After passing through the economizer thermostatic expansion valve 120 the refrigerant combines with the refrigerant which has passed through the hot gas solenoid valve 128. The combined refrigerant is then passed into the cooling section 116 of the economizer heat exchanger 108. Upon leaving the cooling section 116 the refrigerant is combined with the refrigerant that has passed through the liquid injection solenoid 124. This combined refrigerant is then passed toward the auxiliary suction port 36 of the compressor 24.

The portion of refrigerant that entered the heating circuit 52 and was passed toward the evaporator coil 92 passes through the evaporator coil 92, where heat is removed from the refrigerant thus changing the high pressure refrigerant to a middle/low pressure refrigerant. After passing through the evaporator coil 92, the middle/low pressure refrigerant is combined with refrigerant that passed through the pilot solenoid 132, and the combined refrigerant passes toward the suction port 32 of the compressor 24. In some embodiments the refrigerant that leaves the evaporator coil 92 passes through at least one of the accumulator 96 and the electronic throttle valve 100. In other embodiments the liquid injection solenoid 124 may open when suction superheat exceeds a certain amount meaning the cycle is low on refrigerant charge. In yet other embodiments the 3-way valve 68 may temporarily send refrigerant to the condenser coil 72 to remove charge from the heating circuit 52 if it is determined that the cycle is too high on refrigerant charge resulting in liquid refrigerant enter the suction port 32 (too low suction superheat). Yet other embodiments combine both of the aforementioned features and may further utilize at least one of the first unloader solenoid 40 and the second unloader solenoid 44 as well as opening and closing of the hot gas solenoid valve 128 to control the capacity in the heating circuit 52.

When the refrigeration system 20 is run in null cycle, as shown in FIG. 4, the refrigerant flows as follows. The compressor 24 compresses refrigerant to a high pressure, the high pressure refrigerant is then sent toward the 3-way valve 68. Before reaching the 3-way valve 68, a portion of refrigerant passes toward the hot gas solenoid valve 128 which is open during the null cycle. The high pressure refrigerant that passes through the hot gas solenoid valve 128 has its pressure reduced to a middle pressure, and then the middle pressure refrigerant is passed toward the economizer heat exchanger 108. The high pressure refrigerant that passes into the 3-way valve 68 is then passed toward the pilot solenoid 132, which is closed during the null cycle, and the condenser coil 72 where heat is removed from the refrigerant. The high pressure refrigerant then leaves the condenser coil 72 and passes through the condenser check valve 76. After passing through the condenser check valve 76, the high pressure refrigerant enters into the receiver tank 80. The high pressure refrigerant then leaves the receiver tank 80 and a portion of the high pressure refrigerant is passed toward the liquid injection solenoid 124 while a portion of the high pressure refrigerant goes into the hot section 112 of the economizer heat exchanger 108. While passing through the liquid injection solenoid 124 the pressure of the refrigerant is reduced to a middle pressure and is then passed toward the auxiliary suction port 36 of the compressor 24. The portion of refrigerant that enters the hot portion 112 then passes through the economizer thermostatic expansion valve 120 where its pressure is reduced to a middle pressure, thus the temperature is dropped. The refrigerant is then mixed with the middle pressure refrigerant from the hot gas solenoid valve 128 and is then passed into the economizer heat exchanger 108. Upon exiting the economizer heat exchanger 108, the refrigerant then may be mixed with the refrigerant that has passed through the liquid injection solenoid 124 and is passed toward the auxiliary suction port 36. In some embodiments the liquid injection solenoid 124 may close when the temperature of the refrigerant leaving the compressor 24 drops below a certain temperature. In other embodiments the liquid injection solenoid 124 may open when the temperature of the refrigerant leaving the compressor 24 meets or exceeds a certain temperature. Thus a true null cycle is achieved since no heat or cooling is passed to the evaporator coil 92. Null cycles are beneficial when the compressor 24 and fan for moving air through the evaporator are driven by the same prime mover, and it is only desired to have the fans operating.

The refrigeration system 20 thus provides a way to combine a cooling circuit 48, a heating circuit 52, a pressurizing receiver tank circuit 58, a pilot circuit 64, and a liquid injection circuit 62. This combination gives the refrigeration system 20 improved charge control when the refrigeration system 20 is run in the heating or defrost cycle. The improved charge control combined with super-unloading and a null cycle makes it possible to run heating and defrost cycles without an accumulator 96 and electronic throttling valve 100. In some embodiments digital unloading or pulse-width modulation of a scroll compressor is used in place of super unloading. This combination also increases the heating capacity of the refrigeration system 20 and makes it possible to run a true null cycle. In some embodiments the heating capacity of the refrigeration system 20 is increased by using the hot gas line 60 for increased mass flow.

Thus, the invention provides, among other things, a refrigeration system 20.

What is claimed is:

1. A refrigeration system operable to run in a cooling cycle, a heating cycle and a null cycle, the refrigeration system comprising:

a compressor having a suction port and an output port, said compressor configured to receive refrigerant from the suction port, compress the refrigerant, and discharge the refrigerant through the output port;

a condenser selectively connected to the output port and configured to selectively receive the compressed refrigerant from the compressor and condense the compressed refrigerant;

an economizer having a hot section and a cooling section, the hot section and cooling section being in thermodynamic contact with each other, said hot section being connected to the condenser and selectively receiving at least one of the condensed refrigerant from the condenser and the compressed refrigerant from the compressor, said cooling section receiving a first portion of refrigerant which has passed through the hot section, a first expansion device, and a hot gas valve wherein hot gas is selectively mixed with cold two phase refrigerant coming from the first expansion device, a second expansion device connected to the hot section of the economizer and configured to receive a second portion of refrigerant which is not passed to the cooling section of the economizer;

an evaporator connected to the second expansion device and configured to receive refrigerant from at least one of the second expansion device and the compressor output port;

a first solenoid valve fluidly connected to the output port of the compressor, said first solenoid valve selectively allowing the compressed refrigerant to pass through the first solenoid valve to the hot gas valve and then to the cooling portion of the economizer to allow the refrigeration system to run the null cycle and to generate additional mass flow into the compressor during the heating cycle; and a second solenoid valve configured to receive condensed refrigerant which has passed through the condenser, said second solenoid valve selectively allowing the condensed refrigerant to pass through the second solenoid valve to the suction port of the compressor.

2. The refrigeration system of claim 1 further comprising a heating circuit selectively fluidly connected to the output port of the compressor, said heating circuit configured to pass compressed refrigerant to the evaporator to remove heat from the compressed refrigerant.

3. The refrigeration system of claim 2 further comprising a 3-way valve connected to the output port of the compressor and configured to selectively send compressed refrigerant from the output port to at least one of the heating circuit, the condenser, or a second suction port disposed on the compressor.

4. The refrigeration system of claim 3 further comprising a third solenoid valve disposed between the 3-way valve and the second suction port.

5. The refrigeration system of claim 1 further comprising a receiver tank connected to the condenser, a check valve, the hot section of the economizer and the second solenoid valve, the receiver tank configured to receive refrigerant from at least one of the condenser or the check valve, the receiver tank further configured to send refrigerant to at least one of the hot section of the economizer or the second solenoid valve.

6. The refrigeration system of claim 5 further comprising a 3-way valve connected to the output port of the compressor and configured to selectively send compressed refrigerant from the output port to at least one of the evaporator, the condenser, or a second suction port disposed on the compressor.

7. The refrigeration system of claim 6 further comprising an electronic throttling valve connected to the evaporator and the second suction port, the electronic throttling valve configured to receive refrigerant from the evaporator and selectively send refrigerant to the second suction port.

8. The refrigeration system of claim 5, wherein the refrigeration system is operable to run in a pump-down cycle, the system further comprising a liquid line solenoid connected to the hot section of the economizer and the second expansion device to prevent refrigerant from returning to the compressor when the refrigeration system is operating in the pump-down cycle.

9. The refrigeration system of claim 8 wherein when the refrigeration system is operating in the pump-down cycle, the first solenoid valve is closed, the second solenoid valve is closed and the liquid line solenoid is closed.

10. The refrigeration system of claim 1, wherein during the heating cycle of the refrigeration system, the first solenoid valve is configured to be opened to increase the mass flow of refrigerant into the suction port.

11. The refrigeration system of claim 1, wherein during the null cycle of the refrigeration system, the first solenoid valve is configured to be closed to direct vapor to the suction port.

12. The refrigeration system of claim 1, wherein the first solenoid valve is configured to allow the compressed refrigerant to bypass the condenser and to direct the compressed refrigerant to the cooling portion of the economizer.

* * * * *